US009975015B2

(12) United States Patent
Ripp et al.

(10) Patent No.: US 9,975,015 B2
(45) **Date of Patent: *May 22, 2018**

(54) GOLF CLUB HEAD HAVING TEXTURE PATTERN AND METHOD FOR PRODUCING THE SAME

(71) Applicant: DUNLOP SPORTS CO. LTD., Kobe-shi, Hyogo (JP)

(72) Inventors: Patrick Ripp, Seal Beach, CA (US); Roberto Aguayo, Downey, CA (US); Michael J. Kline, Newport Beach, CA (US)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/372,748

(22) Filed: Dec. 8, 2016

(65) Prior Publication Data

US 2017/0087425 A1 Mar. 30, 2017

Related U.S. Application Data

(63) Continuation of application No. 14/310,704, filed on Jun. 20, 2014, now Pat. No. 9,539,477.

(51) Int. Cl.
*A63B 53/04* (2015.01)
*A63B 60/00* (2015.01)

(52) U.S. Cl.
CPC ..... *A63B 53/047* (2013.01); *A63B 53/04* (2013.01); *A63B 53/0466* (2013.01); *A63B 2053/0445* (2013.01); *A63B 2060/004* (2015.10); *Y10T 29/49998* (2015.01)

(58) Field of Classification Search
CPC ..... A63B 53/04; A63B 53/0466; A63B 2053/0445; A63B 2060/004; Y10T 29/49998
USPC ..... 473/331, 330
See application file for complete search history.

(56) References Cited

U.S. PATENT DOCUMENTS

| | | | | |
|---|---|---|---|---|
| D606,605 | S | 12/2009 | Wada et al. | |
| D607,071 | S | 12/2009 | Wada et al. | |
| 9,539,477 | B2 * | 1/2017 | Ripp | A63B 53/047 |
| 9,636,757 | B1 * | 5/2017 | Rice | B23C 3/30 |
| 2008/0108453 | A1 | 5/2008 | Park et al. | |
| 2008/0125243 | A1 | 5/2008 | Ban | |
| 2009/0176597 | A1 | 7/2009 | Yamagishi et al. | |
| 2009/0318243 | A1 | 12/2009 | Golden et al. | |

(Continued)

OTHER PUBLICATIONS

Cobra Golf Tour Trusty Rusty Wedge-Type Golf Club. <http://www.cobragolf.com/2013-cobra-tour-trusty-wedge>. Sep. 6, 2013.

*Primary Examiner* — Benjamin Layno
(74) *Attorney, Agent, or Firm* — Oliff PLC

(57) ABSTRACT

Provided are a golf club head and a method for producing the golf club head. The golf club head comprises a striking face that in turn comprises a recurrent texture pattern that has a period T and that is defined by a plurality of depressions, each depression having an average depth no greater than 0.10 mm. The striking face also comprises a plurality of scorelines that at least partially intersect the recurrent texture pattern and that have a scoreline pitch Ps such that T/Ps is greater than 1.0, each scoreline having an average depth no less than 0.10 mm.

18 Claims, 11 Drawing Sheets

(56) References Cited

U.S. PATENT DOCUMENTS

| | | | |
|---|---|---|---|
| 2010/0029401 | A1 | 2/2010 | Nakamura |
| 2010/0087270 | A1 | 4/2010 | Ban et al. |
| 2010/0113180 | A1 | 5/2010 | Nakamura |
| 2011/0269567 | A1 | 11/2011 | Ban et al. |
| 2013/0085011 | A1 | 4/2013 | Serrano et al. |
| 2013/0331197 | A1 | 12/2013 | Hackenberg |

* cited by examiner

GOLF CLUB HEAD HAVING TEXTURE PATTERN AND METHOD FOR PRODUCING THE SAME

This application is a Continuation Application of U.S. patent application Ser. No. 14/310,704, filed on Jun. 20, 2014, now U.S. Pat. No. 9,539,477. The disclosure of the prior application is incorporated herein by reference in its entirety.

BACKGROUND

The present disclosure relates to a striking face design for golf club heads, and more particularly to a striking face design for iron and wedge-type golf club heads.

The ability of a texture pattern on the striking face of a golf club head to enhance overall spin of a struck golf ball is well-known in the art. The texture pattern increases the roughness of the striking face, and thus enhances the friction between the club head and the golf ball upon contact. By enhancing overall spin, golfers are better able to locate shots and control the movement of the struck golf ball once it has returned to the ground.

SUMMARY

The United States Golf Association ("USGA"), which governs golf equipment for all USGA sponsored events at affiliated golf courses, limits the surface roughness of the striking faces of iron and wedge-type golf clubs. In particular, with the exception of separately-regulated scorelines, the striking faces of iron and wedge-type golf clubs may be no rougher than that of "decorative sandblasting." This USGA requirement has been interpreted to require that the striking face cannot have an average surface roughness Ra greater than 180 μin or a maximum average peak-to-trough value greater than 1,000 μin. Notwithstanding the general nature of these regulations, maximum average peak-to-trough length is conventionally characterized by the standard surface roughness parameter, average maximum profile height Rz.

As an additional complication, it is difficult for manufacturers to consistently hit target surface roughness characteristics (e.g., Ra and Rz) from club head to club head. Rather, some amount of dispersion is present over a product sample set. The USGA generally allows for some degree of dispersion (e.g., an individual manufacturer cannot have over 10% of its products be nonconforming), but the degree of dispersion effects what may be reasonably chosen as target surface roughness values. For example, target surface roughness values should be set farther from applicable limits with increasing degree of dispersion.

It is possible, according to the present disclosure, to provide a golf club head with a striking face sufficient to optimize overall spin of a struck golf ball but that also complies with USGA regulations governing surface roughness and dispersion.

This may be achieved by one or more aspects of the present disclosure. For example, the present disclosure provides a golf club head comprising a striking face, the striking face comprising: a recurrent texture pattern that has a period T and that is defined by a plurality of depressions, each depression having an average depth no greater than 0.10 mm; and a plurality of scorelines that at least partially intersect the recurrent texture pattern and that have a scoreline pitch Ps such that T/Ps is greater than 1.0, each scoreline having an average depth no less than 0.10 mm.

Such an advantageous golf club head may be produced by a manufacturing method according to one or more aspects of the present disclosure, the method comprising: milling on a striking face of a club head body, in a first pass, a first plurality of auxiliary grooves having a first groove pitch P1 no less than 0.010 in; and milling on the striking face, in a second pass, a second plurality of auxiliary grooves that are at least partially coextensive with the first plurality of grooves and that have a second groove pitch P2 that is no less than 0.010 in and that is different from the first pitch.

In another example, a golf club head according to one or more aspects of the present disclosure may comprise a striking face including a textured region having a maximum profile height parameter Rt no less than 1000 μin and an average maximum profile height parameter Rz no greater than 1000 μin.

In yet another example, a golf club head according to one or more aspects of the present disclosure may comprise: a striking face having: a recurrent texture pattern defined by a plurality of depressions having a period T of no less than 0.20 in and no greater than 0.35 in, each depression having an average depth no greater than 0.10 mm.

These and other features and advantages of the golf club head according to the various aspects of the present disclosure will become more apparent upon consideration of the following description, drawings, and appended claims. The drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 1-5, 2-3, 2-4, 2-5, 3-4, 3-5, and 4-5.

DETAILED DESCRIPTION OF THE EMBODIMENTS

Figure 1:
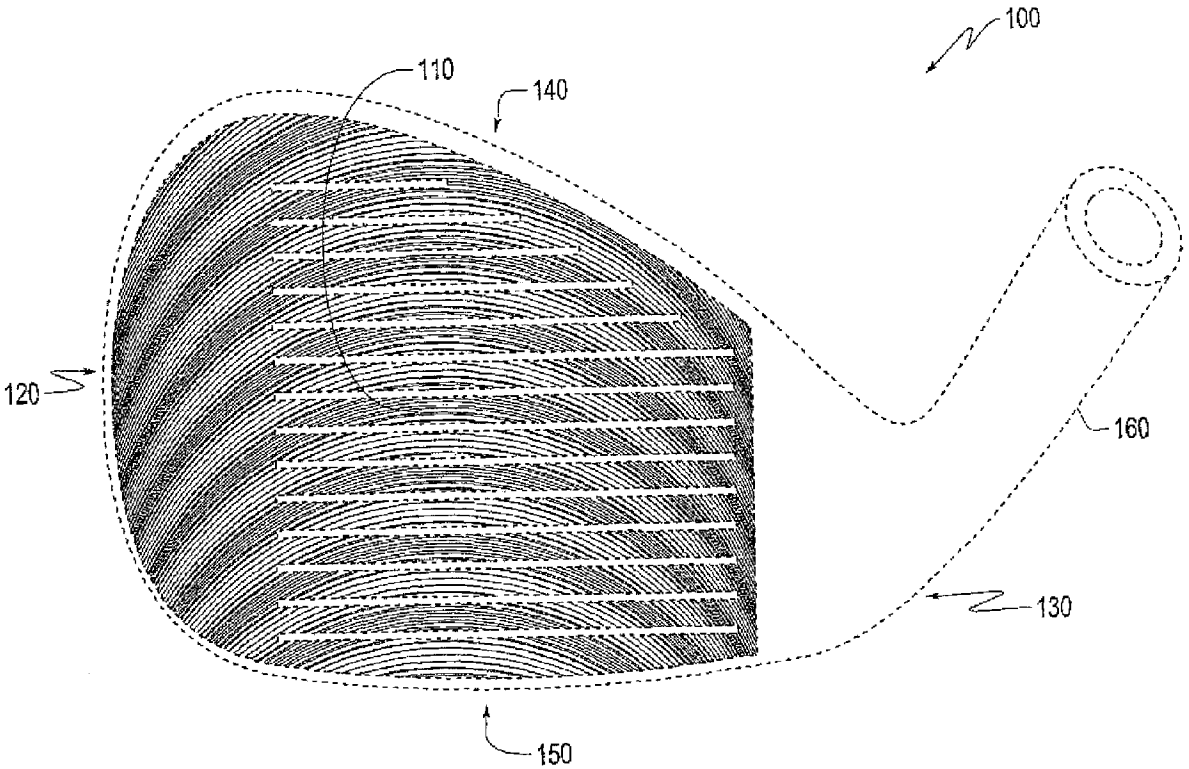
FIG. 1 shows a front view of an exemplary golf club head in accordance with one or more aspects of the present disclosure.

Shown in FIG. 1 is a golf club head 100 according to one or more aspects of the present disclosure. In particular, the golf club head 100 may be any type of golf club head (e.g., iron-type, wedge-type, wood-type, putter-type, or hybrid type). Preferably, the golf club head 100 comprises an iron or wedge-type club head, in which spin generation is more frequently desired. The club head 100 may comprise, when oriented in a reference position, a toe portion 120, a heel portion 130, a top portion 140, and a sole portion 150, each contiguous to a striking face 110 of the club head 100. The reference position is the orientation of the club head 100 relative to a virtual ground plane, wherein the sole portion 150 rests on the ground plane such that a hosel axis (described below) is coplanar with a virtual vertical hosel plane and scorelines in the striking face 110 (also described below) are horizontal. The striking face 110 forms a virtual striking face plane, which is generally coplanar with the striking face 110. Unless otherwise specified, parameters described herein are to be determined with a club head in a reference position. Also, various club head embodiments may not be shown in a reference position herein. For example, in FIGS. 1-6 and 8-9, the club head 100 is shown in a position in which the scorelines 220 are horizontal, but with the virtual striking face plane rotated forward from a reference position orientation to being parallel with the plane of the paper. This particular orientation more clearly illustrates various texture patterns of the striking face. Where the striking face 110 is not planar (e.g., contains a bulge and/or roll), the virtual striking face plane should be considered to be a plane generally tangent to the striking face 110 at a face center of the striking face 110. Face center, as used herein, refers to the point on a striking face of a club head (having scorelines) that is halfway between the heel-most extent and the toe-most extent of the scorelines, and halfway between the topmost extent and sole-most extent of the scorelines, in the case of horizontal scorelines.

When in the reference position, the virtual striking face plane forms an angle relative to the vertical hosel plane, known as the loft or loft angle of the club head 100. The loft angle may be, for example, between 8° and 65°, more preferably no less than 22°, and even more preferably no less than about 42°. Additionally, a hosel 160 may extend from the heel portion 130 so as to provide an attachment point for a golf club shaft (not shown), the axis of the hosel 160 being collinear with the axis of the shaft.

Figure 2:
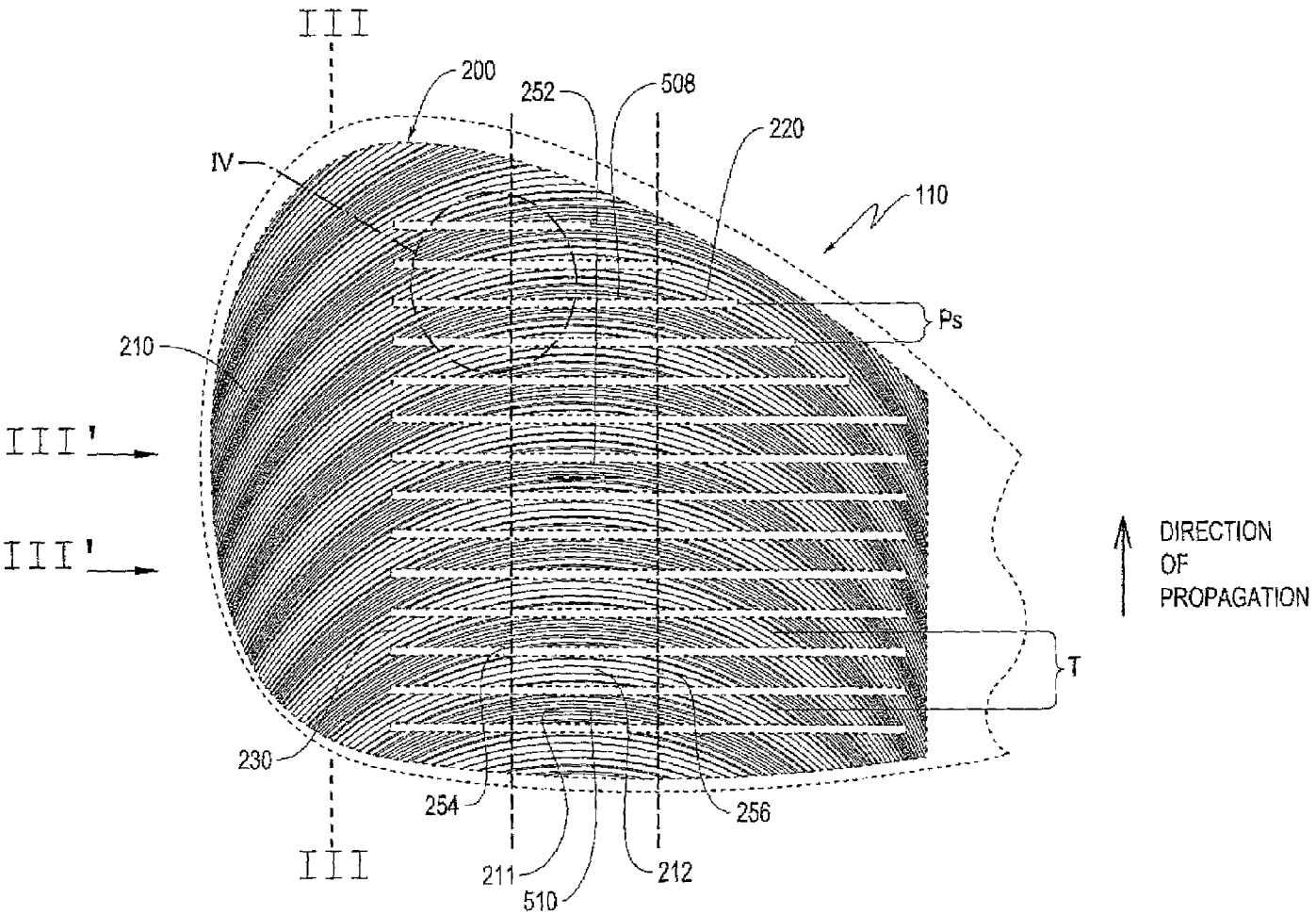
FIG. 2 shows the striking face of the golf club head of FIG. 1.

Turning to FIG. 2, a recurrent texture pattern 200 may be provided on the striking face 110 of the club head 100. This recurrent texture pattern 200 may be an interference pattern that comprises a plurality of arcuate grooves 210 of varying depths. At least some of the plurality of grooves may each be arcuate and follow paths that are, at least in part, upwardly (i.e., from the sole portion 150 toward the top portion 140) convex. In alternative embodiments, such grooves may, at least in part, follow upwardly concave paths, yet include like surface roughness and profile-based characteristics as in the embodiments shown in FIGS. 1-4 and as described below. In other alternative embodiments, such grooves may, at least in part, follow linear paths, yet include like surface roughness and profile-based characteristics as in the embodiments shown in FIGS. 1-4 and as described below. In other embodiments, such grooves may, at least in part, follow angled linear paths (e.g., chevron-shaped paths or plateau-shaped paths), yet include like surface roughness and profile-based characteristics as in the embodiments shown in FIGS. 1-4 and as described below. In such embodiments, such chevron-shaped paths or plateau-shaped paths are preferably centered on, or alternatively substantially near, the intersection between the striking face and a virtual vertical plane perpendicular to the striking face plane and passing through the face center 252. The plurality of grooves 210 preferably propagate from the sole portion 150 to the top portion 140. Specifically, the plurality of grooves 210 preferably extend entirely from the sole portion 150 to the top portion 140 of the generally planar striking face 110. However, in alternative embodiments, the plurality of arcuate grooves extend only partially between the sole portion 150 and the top portion 140. The arcuate grooves 210 generally have an average depth, defined in a direction perpendicular to the plane of the striking face 110, of no greater than 0.10 mm. Preferably, the arcuate grooves 210 have an average depth no greater than 0.05 mm, and even more preferably no greater than 0.035 mm. Additionally, or alternatively, the respective average depths of the arcuate grooves 210 vary. Preferably, average depths vary such that a maximum average groove depth is within the range of 0.015 mm and 0.040 mm and a minimum average groove depth is within the range of 0.001 mm and 0.008 mm. A vertical cross-sectional view of a representative portion of the recurrent texture pattern 200 is shown schematically in FIG. 3. The cross-sectional characteristics of the recurrent texture pattern 200 shown in FIG. 3 result from consonance and dissonance naturally resulting from an interference pattern.

Returning to FIG. 2, a plurality of parallel scorelines 220 may also be formed in the striking face 110. The scorelines 220 may extend from the heel portion 130 toward the toe portion 120, and an average depth of the scorelines 220, defined in the direction perpendicular to the plane of the striking face 110, is preferably no less than 0.10 mm. More preferably, the average depth of the scorelines is no less than 0.25 mm, and even more preferably no less than 0.30 mm, and even more preferably between about 0.30 mm and 0.40 mm. A pitch Ps of the scorelines 220, the pitch Ps being the minimum spacing between the scorelines 220 measured from the center of one scoreline to the center of an adjacent scoreline, may be between 0.12 in and 0.16 in, and more preferably equal to about 0.14 in. Preferably, all scorelines 220 in the striking face are oriented at a constant pitch Ps. However, in alternative embodiments, the pitch Ps varies between at least two pairs of adjacent scorelines. In certain aspects, each of the scorelines 220 may have a cross-sectional area, relative to the plane of the striking face 110, of 0.000365 $in^2$; a width W, based on the USGA defined 30° rule, of 0.0329 in; a pitch Ps of 0.14 in; a maximum depth, in the direction perpendicular to the plane of the striking face 110, of 0.0143 in; and a draft angle of side walls, relative to the depth direction, of 17.0°.

Figure 4:
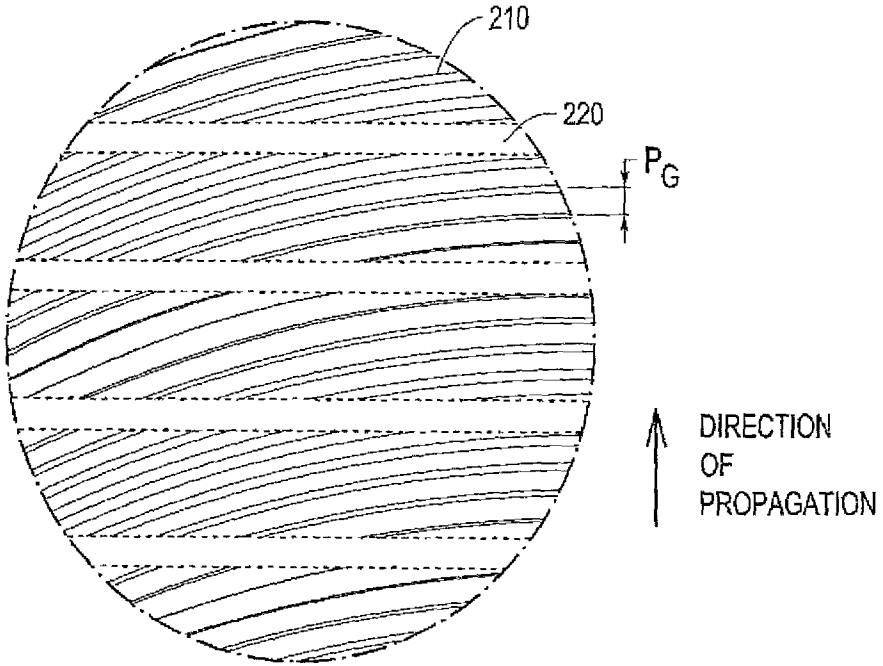
FIG. 4 shows a magnified view of a portion of the striking face of the golf club head of FIG. 1.
Figure 5A:
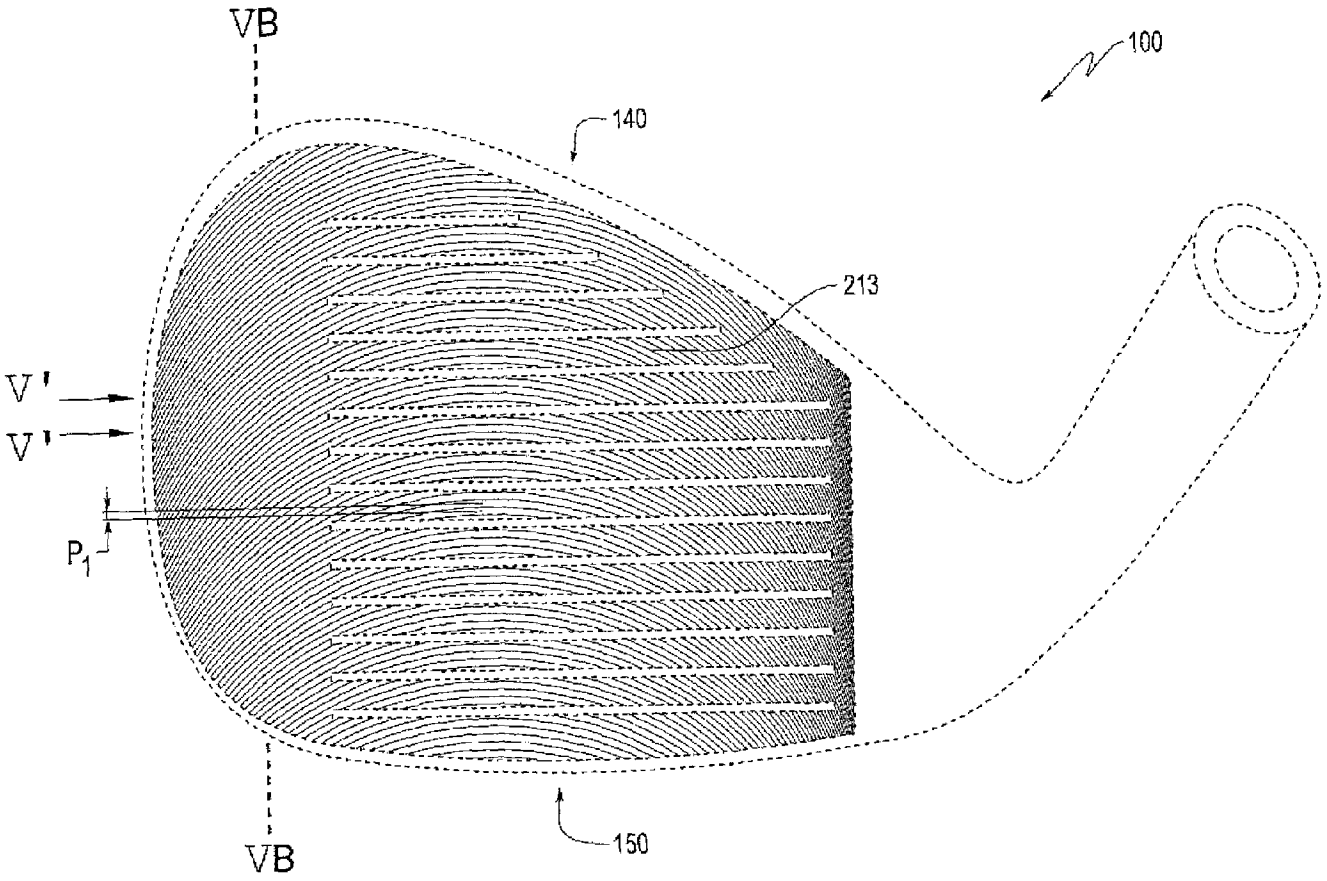
FIG. 5A shows a first plurality of auxiliary arcuate grooves formed in the striking face of the golf club head of FIG. 1.
Figure 5B:
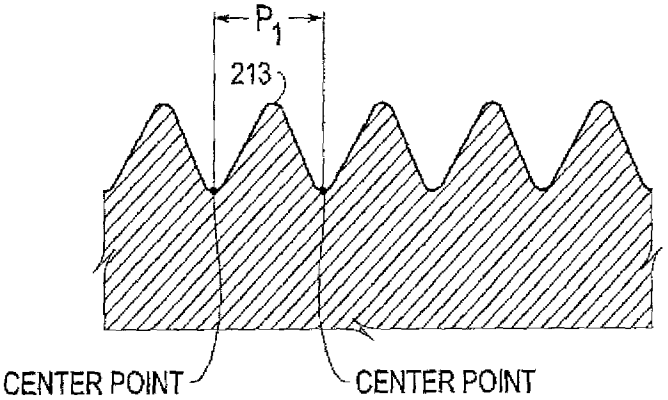
FIG. 5B shows a cross-sectional view of a portion of the golf club head of FIG. 5A through the plane VB-VB.
Figure 6A:
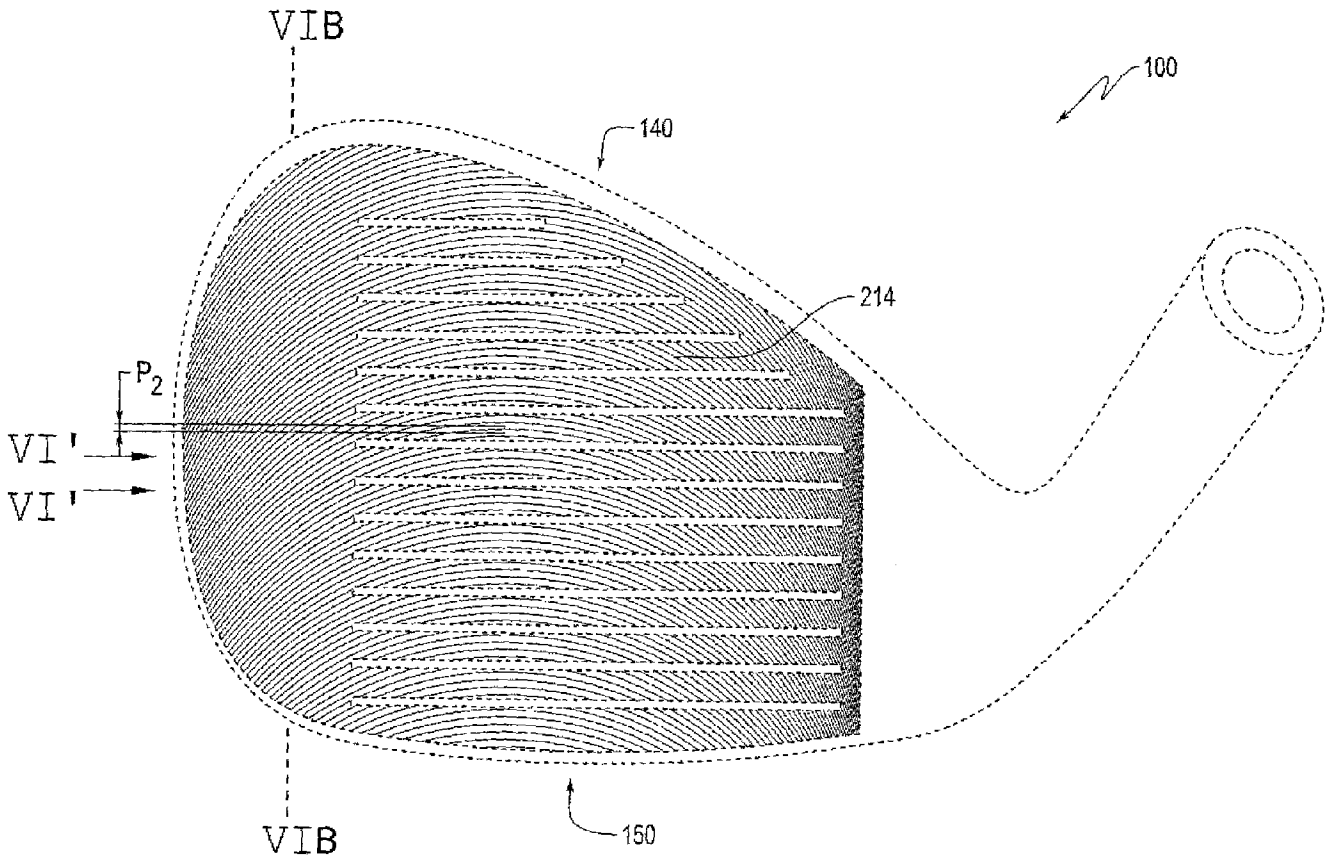
FIG. 6A shows a second plurality of auxiliary arcuate grooves formed in the striking face of the golf club head of FIG. 1.
Figure 6B:
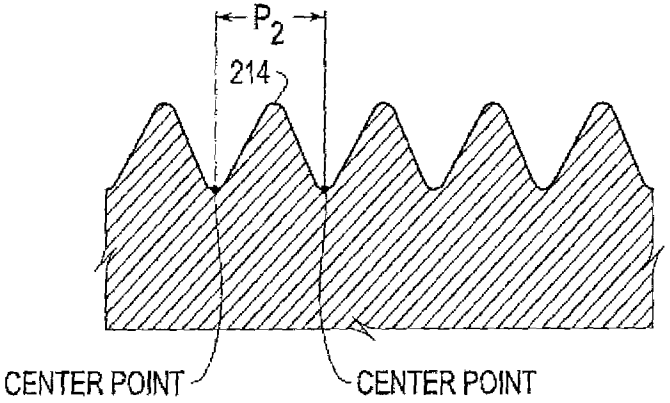
FIG. 6B shows a cross-sectional view of a portion of the golf club head of FIG. 6A through the plane VIB-VIB.

As shown in FIG. 4, the pitch $P_G$ of the arcuate grooves 210 preferably varies in the propagation direction from the sole portion 150 toward the top portion 140. As used herein, propagation direction refers to the general direction in which a pattern advances. A pattern may, like waves generated from a point source, for example, propagate in plural directions. Preferably, however, the pattern of arcuate grooves 210 propagates in a single direction. Preferably, such direction corresponds to the sole-to-top direction of the golf club head. By way of example, in some embodiments, the surface grooves 210 are formed by one or more surface milling operations in which a milling cutter is passed along an intermediate striking face in a specified feed direction. In this particular case, the direction of propagation corresponds to the feed direction of the milling cutter as may be evidenced by the orientations of the arcuate grooves relative to each other. In alternative embodiments, the arcuate grooves 220 propagate in a direction at an angle from the sole-to-top direction (such angle measured in the virtual striking face plane). In such alternative embodiments, the direction of propagation is at an angle no greater than 20° from the sole-to-top direction, and more preferably no greater than 15° from the sole-to-top direction. As used herein, the arcuate groove pitch $P_G$ refers to the spacing of adjacent grooves measured from groove center point to groove center point in the direction of propagation of the grooves (as shown, by way of example, in FIG. 4).

Figure 3:
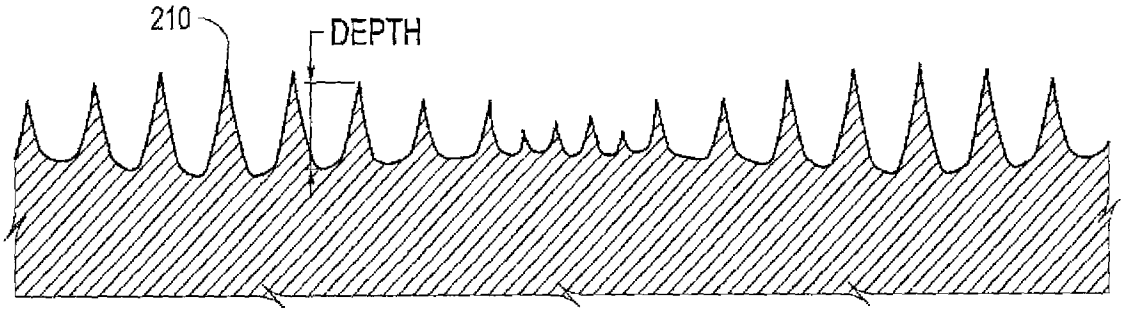
FIG. 3 shows a cross-sectional view of a representative arcuate groove containing portion of the striking face of the golf club head of FIG. 1.

More specifically, with reference to FIG. 2, the arcuate grooves 210 may form a pattern comprising a plurality of low amplitude regions 211, having a relatively small pitch $P_G$, and a plurality of high amplitude regions 212, having a relatively larger pitch $P_G$, as shown for example in FIG. 3. In some embodiments, the pattern formed by the arcuate grooves 210 transitions abruptly between grooves having high amplitudes and grooves having low amplitudes. However, preferably, the pattern is such that amplitude gradually transitions between high amplitude regions and low amplitude regions. The pattern formed by the low amplitude regions 211 and the high amplitude regions 212 may repeat at a period T. A recurrent pattern's period T, as used herein, refers to the length of the pattern (in its elemental instance) measured in its direction of propagation. In the particular embodiment shown in FIGS. 1-4, a pattern of arcuate grooves 210 that forms high amplitude regions 212 and low amplitude regions 211 recurs at a period T. The period T, in this case, corresponds to the distance between adjacent high amplitude regions 211 or adjacent low amplitude regions 212 taken in the direction of propagation (i.e., from the sole portion 150 to the top portion 140 in this particular embodiment). The period T is preferably no less than 0.15 in. More specifically, the period T is preferably between 0.2 in and 0.35 in.

Alternatively, or in addition, the period T of the recurrent texture pattern 200 is preferably related to the pitch Ps of the scorelines 220. For example, the period T may be greater than the pitch Ps of the scorelines 220 (i.e., T/Ps may be greater than 1.0). More specifically, the ratio of the period T of the texture pattern 200 to the pitch Ps of the scorelines 220 may be between 1.50 and 2.50 (i.e., $1.50 \leq T/Ps \leq 2.50$). Even more specifically, the ratio of the period T of the texture pattern 200 to the pitch Ps of the scorelines 220 may be between 1.75 and 2.25 (i.e., $1.75 \leq T/Ps \leq 2.25$). Yet even more specifically, the period T may be about twice the pitch Ps of the scorelines 220. Additionally, or alternatively, T and Ps may satisfy the following relationship: $0.85 \leq T/(N*Ps) \leq 1.15$, wherein N is a whole number greater than 1. More specifically, T and Ps may satisfy the following relationship: $0.95 \leq T/(N*Ps) \leq 1.05$, wherein N is a whole number greater than 1.

In certain aspects, the high amplitude regions 212 may generally coincide with landing areas 230 between the scorelines 220. In a preferred embodiment, the high amplitude regions 212 generally coincide with alternating landing areas 230 in a central region of the striking face 110. In an even more preferred embodiment, the high amplitude regions 212 generally coincide with those landing areas 230 in the lower portion of the central region, for example, beginning with the first (lowermost) landing area, and upwardly through the third, fifth, and seventh landing areas, the first through eight landing areas in the example illustrated in FIG. 2 corresponding to an area of the striking face where ball impacts most frequently occur. Specifically, the high amplitude regions 212 preferably coincide with such landing areas 230 in a region 508 of the striking face 110 delimited by a first virtual vertical plane 254, perpendicular to the virtual striking face plane and spaced from the face center 252 by a shortest toe-ward distance of 0.50 inches, and a second virtual vertical plane 256, perpendicular to the virtual striking face plane and spaced from the face center 252 by a shortest heel-ward distance of 0.50 inches. Even more preferably, high amplitude regions coincide with such landing areas 230 in central sub-region 510 of the region 508 even more preferably defined by being below the face center 252. In certain aspects, the high amplitude regions 212 may be matched with the landing areas 230 in at least three instances over the striking face 110. Other configurations are of course possible.

The recurrent texture pattern 200 having one or more of the above arrangements may help imbue the striking face 110 with desirable surface roughness characteristics. It is to be noted that the striking face 110 may be further processed. For example, the striking face 110 may be subjected to a nickel (Ni) and/or chrome (Cr) plating processes. These processes, as well as other surface treatments described below, may have a non-negligible impact upon the surface roughness characteristics of the striking face 110. For example, these additional surface treatment processes may increase average surface roughness Ra by up to 100 μin. Thus, the recurrent texture pattern 200 alone may not result in the desired surface roughness characteristics. Thus, the desired metrological characteristics of the striking face 110 resulting from the formation of the texture pattern 200 preferably accounts for any surface processing that may occur prior to, or subsequent, the formation of the texture pattern 200.

In certain aspects, the average surface roughness Ra of the striking face 110 may be between about 80 μin and 120 μin, the average maximum profile height Rz may be no greater than 1000 μin, and the maximum profile height Rt of the striking face 110 may be no less than 1000 μin. More specifically, the average maximum profile height Rz may be no greater than 900 μin, and the maximum profile height Rt may be no less than 1020 μin. Even more specifically, the average maximum profile height Rz may be 861 μin, and the maximum profile height Rt may be 1029 μin. These values, as may be achieved by the texture patterns variously described herein, result in a striking face having greater ball spin characteristics while conforming to the regulations of the USGA.

Average surface roughness Ra and average maximum profile height Rz are measured under standard ASME/ISO conditions well known to those skilled in the art, say under the requirements of ISO 4288, shown in Table 1 below (units are converted).

TABLE 1

Roughness Sampling Lengths for the Measurement of Ra, Rz, Curves, and Related Parameters for Non-Periodic Profiles

| Ra (μin) | Roughness Sampling Length (in) | Roughness Evaluation Length (in) |
|---|---|---|
| 0.23622 < Ra < 0.7874 | 0.00315 | 0.015748 |
| 0.7874 < Ra < 3.937 | 0.009843 | 0.049213 |
| 3.937 < Ra < 78.74 | 0.031496 | 0.15748 |
| 78.74 < Ra < 393.7 | 0.098425 | 0.492126 |
| 393.7 < Ra < 3149.6 | 0.314961 | 1.574803 |

For example, an Ra value of between 100 and 180 μin corresponds to a roughness evaluation length of 0.492126 in. To obtain Rz, this evaluation length is divided into 5 equal sub-segments, and the maximum peak-to-trough value of each sub-segment is measured and averaged with the maximum peak-to-trough value of the other sub-segments. Rt in turn corresponds to the actual peak-to-trough dimension over the evaluation length. Because of this distinction in measurement, by forming texture patterns in the manners described herein, striking face regions could be generated having maximum peak-to-trough dimensions greater than 1,000 μin, and selectively positioned in advantageous locations, while Rz would remain below 1000 μin.

Figure 7:
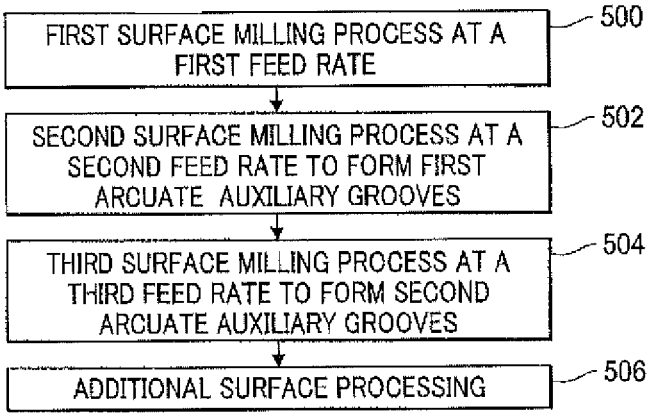
FIG. 7 shows a flowchart illustrating a texture forming process in accordance with one or more aspects of the present disclosure.

A method of forming the recurrent texture pattern 200 on the club head 100 is described below with reference to FIGS. 5-7. As specifically shown in FIG. 7, in a first step 500, a surface milling cutter may be fed along a blank striking face 110 at a slow feed rate, say 20 in/min, and at a high spin rate, say 3500 rev/min. Because of the slow feed rate and the high spin rate, this first step serves to "clean" the striking face 110 in preparation for subsequent steps.

In a second step 502, the surface milling cutter may be again fed over the striking face 110 to create a first set of arcuate auxiliary grooves 213. In this second step, the cutter may be fed at a higher feed rate such as 53.145 in/min, at a greater depth such as 0.00197 in, but at a slower spin rate such as 1680 rev/min. In the direction of propagation from the sole portion 150 to the top portion 140, the first set of arcuate auxiliary grooves 213 may be evenly spaced, having a pitch P1 from the center of one groove to the center of an adjacent groove of no less than 0.01 inches. More preferably, the pitch P1 is no less than 0.020 in, even more preferably between 0.020 in. and 0.030 in., and yet even more preferably substantially equal to about 0.0262 in. The arcuate auxiliary grooves 213 as well as their pitch P1 are shown on the striking face 110 in FIGS. 5A and 5B.

In a third step 504, the surface milling cutter may be again fed over the striking face 110 to create a second set of arcuate auxiliary grooves 214. In this step, the cutter may be fed across the striking face 110 at the same depth and spin rate as in the second step, but at a feed rate different than the feed rate in the second step, say 47.88 in/min. In the direction of propagation from the sole portion 150 to the top portion 140, the second set of arcuate auxiliary grooves 214 may also be evenly spaced, may also have a pitch P2 from the center of one groove to the center of an adjacent groove of no less than 0.01 inches, and may also be generally parallel to (and/or concentric with) the first set of arcuate auxiliary grooves 213. Preferably, the pitch P2 is no less than 0.015 in, more preferably between 0.020 in. and 0.030 in., and even more preferably substantially equal to about 0.0238 in. The arcuate auxiliary grooves 214 as well as their pitch P2 are shown, without the arcuate auxiliary grooves 213, on the striking face 110 in FIGS. 6A and 6B. Note that arcuate grooves 214 are preferably superimposed on the arcuate grooves 213 to result in an interference pattern (e.g., as described above with regards to FIGS. 1-4). However, the arcuate grooves 213 are omitted from view in FIG. 6 to more clearly show the arcuate grooves 214.

Preferably, identical or same cutter bits are used in this step 504 as in the second milling step 502. In alternative embodiments, however, a different bit is used (e.g., varying in cross-sectional diameter and/or other profile feature). Further, in alternative embodiments, the second set of arcuate auxiliary grooves 214 are formed in a propagation direction different from the first set of arcuate grooves 213. For example, in some such embodiments, the second set of arcuate grooves 214 are formed in a propagation direction that is angled from the sole-to-top direction, preferably at an angle no greater than 20°.

But because pitch is dependent upon feed rate and spin rate and because of the difference in feed rates between the second and third steps, the pitch P2 of the second set of arcuate auxiliary grooves 214 may be different than the pitch P1 of the first set of arcuate auxiliary grooves 213. For example, the pitch P1 of the first set of auxiliary grooves 213 may be larger than the pitch P2 of the second set of auxiliary grooves 214. More specifically, the ratio of the pitch P1 to the pitch P2 may be between 1.05 and 1.20, inclusive (i.e., $1.05 \leq P1/P2 \leq 1.20$). Even more specifically, the ratio of the pitch P1 to the pitch P2 may be 1.1. As shown in FIG. 2, the first and second sets of arcuate auxiliary grooves 213, 214 may be at least partly coextensive, thereby combining to form the arcuate grooves 210. As illustrated, these coextensive arcuate grooves 210 may reside on regions of the striking face generally distal from the face center 252, for example, proximate the toe and/or heel regions of the club head 100. While the formation of the first set of arcuate grooves 213 is described as preceding the formation of the second set of arcuate grooves 214, in alternative embodiments, such milling operations 502 and 504 are reversed.

Preferably, as described above, the second milling process 502 and the third milling process 504 occur at the same cutting depth. Specifically, both milling processes 502 and 504 occur at a cutting depth between 0.0010 in and 0.0030 in, more preferably between 0.0015 in and 0.0025 in, and even more preferably at a cutting depth substantially equal to 0.00197 in. Performing multiple milling passes at the same cutting depth advantageously reduces dispersion in surface roughness characteristics. Reductions in dispersion in turn enable manufactures to increase target surface roughness characteristics closer to regulated limits. In alternative embodiments, however, the cutting depth may vary between the second milling process 502 and the third milling process 504.

In alternative embodiments, a texture pattern having variable amplitude in the manners described above with regard to the embodiments of FIGS. 1-4 (and having like surface roughness characteristics) is formed by other means. For example, in some embodiments, such a variable amplitude texture pattern is formed by means of a stamping die. In such embodiments, a stamping die having thereon a texture pattern is brought into contact under pressure with an intermediate striking face to form a variable amplitude texture pattern. Alternatively, in some embodiments, such a variable amplitude texture pattern is formed by at least one milling process in which a feed rate varies from a slower rate to a faster rate, preferably in a cyclical manner. Such processes may form variable amplitudes because slower feed rates (even if a milling cutter is set at a constant cutting depth) may naturally result in narrower grooves having lower amplitudes than grooves formed at faster feed rates.

Additional surface processing is preferably performed to the striking face 110 having the recurrent texture pattern 200 in step 506. For example, the striking face 210 may be nickel (Ni) and/or chrome (Cr) plated. Additionally or alternatively, a laser-milling process may be used to generate superimposed laser-milled lines on the striking face 110. Additionally and/or alternatively, the striking face 110 may also be subjected to at least one of sandblasting, laser etching, chemical etching, peening, media blasting, anodizing, and PVD coating.

The above-described club head 100 and method for producing the club head 100 provide at least the following distinct advantages. The striking face 110 with the recurrent texture pattern 200 possesses a difference between maximum profile height Rt and average maximum profile height Rz that is generally greater than other club heads. Furthermore, high roughness areas, such as the high amplitude regions 212, may be selectively provided in more advantageous locations on the striking face 110, say where ball impacts most frequently occur. By having a greater difference between Rt and Rz and by providing these high roughness areas where ball impacts most frequently occur, the spin characteristics of the clubhead 100 are generally improved.

Figure 8:
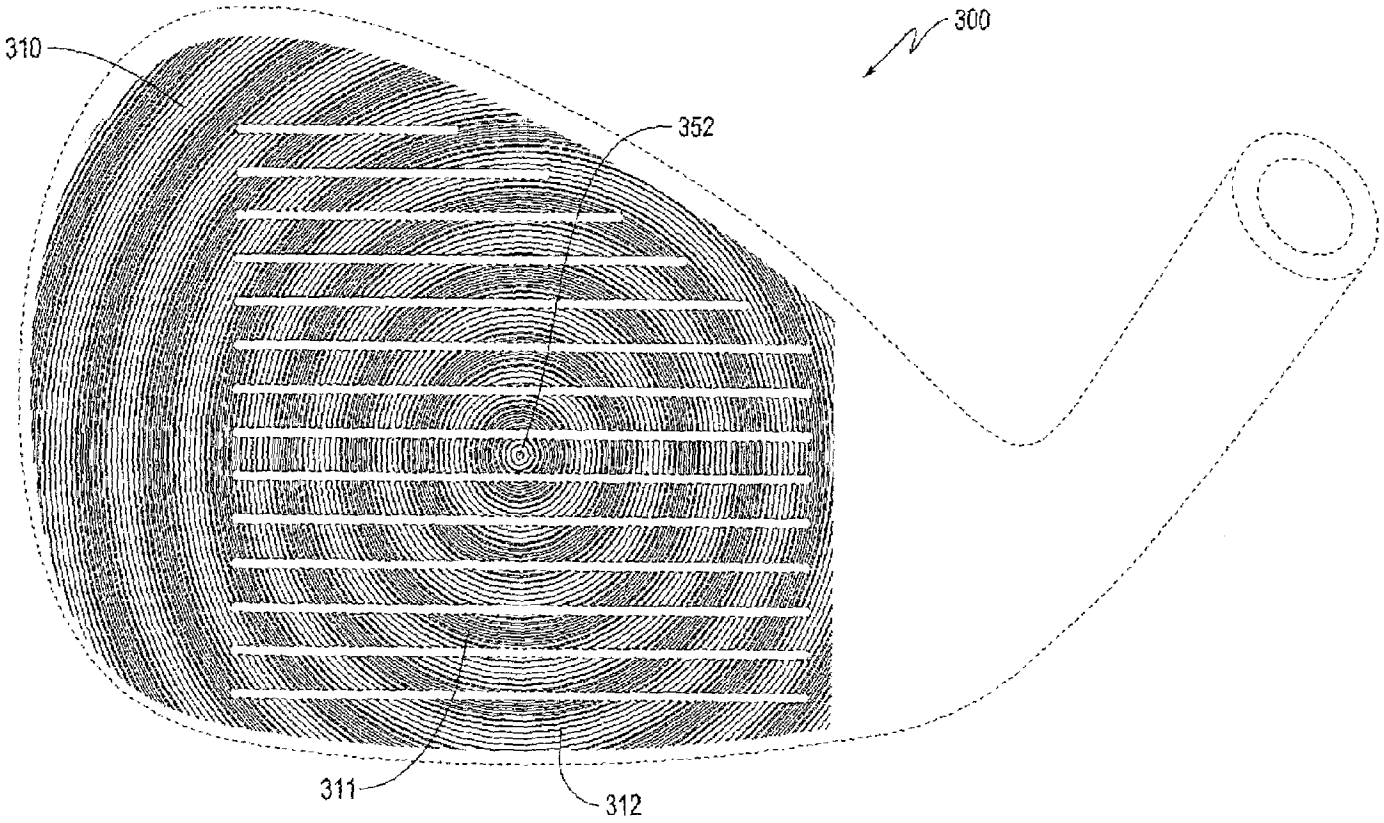
FIG. 8 shows a front view of an exemplary golf club head in accordance with one or more aspects of the present disclosure.

For example, as shown in Chart #1 below, the performance of a wedge-type club head having a surface pattern as described with regard to FIGS. 1-4 was compared with a conventional wedge (i.e., the 2012 Cleveland Golf® RTX SW). Both club heads were similar in terms of loft, Ra, and Rt. However, the conventional wedge included a typical, generally non-variable depth striking face milling pattern. Each club head was subjected to mechanical testing, in which full shots, pitch shots, wet conditions, and dry conditions were simulated and applied to each club head. Notably, both club heads performed well under dry conditions. However, the exemplary club head demonstrated significant increases in spin under wet conditions for both a pitch shot and a full shot. This improvement is significant in that spin, on dry shots, is generally viewed as acceptable by golfers, whereas spin, on wet shots, is generally viewed as needing improvement. The exemplary club head thus appears to close the gap between acceptable spin on dry shots and acceptable spin on wet shots.

may comprise concentric circles that radiate outwardly from the face center 352 generally similar to wave propagation from a point source, wherein the face center 352 comprises the point source. As illustrated, such pattern may also include high amplitude regions 312 and low amplitude regions 311 as described herein. Such embodiment as illustrated in FIG. 8 may impart a visual cue to a user of the club head 300 for more readily identifying the face center 352, for example, at address. In alternative embodiments, such concentric circular grooves may be centered at a location different from the face center 352. For example, such circular grooves may be centered at a predetermined optimal impact point that is different from the face center. Such concentric circular auxiliary arcuate grooves 310 may be formed, for example, by stamping, via chemical etching, via laser etching, via sandblasting or other form of media blasting, or other known processes.

Figure 9:
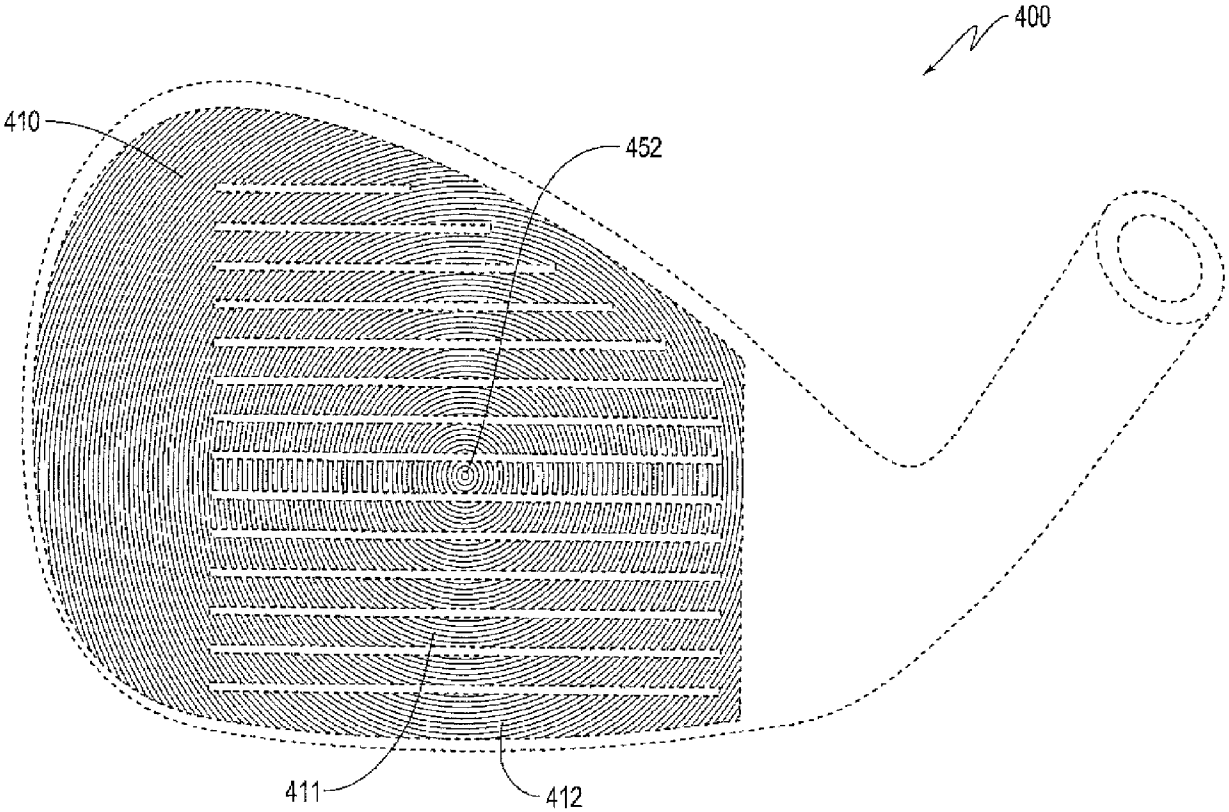
FIG. 9 shows a front view of an exemplary golf club head in accordance with one or more aspects of the present disclosure.

In an alternate preferred embodiment, illustrated in FIG. 9, a club head 400 may include auxiliary arcuate grooves 410 that may comprise a series of concentric circles that may radiate outwardly. For example, the arcuate grooves may comprise concentric circles that radiate outwardly from the face center 452 generally similar to wave propagation from a point source, wherein the face center 452 comprises the point source. In this embodiment, the arcuate grooves may include substantially similar cross-sectional amplitudes. Such embodiment as illustrated in FIG. 9 may impart a visual cue to a user of the club head 400 for more readily identifying the face center 452, for example, at address. In alternative embodiments, such concentric circular grooves may be centered at a location different from the face center

CHART #1

| Club head | Texture pattern | Loft angle (°) | Ra (μin) | Rt (μin) | Rz (μin) | Spin rate in dry conditions - pitch shot (rpm) | Spin rate in dry conditions - full shot (rpm) | Spin rate in wet conditions - pitch shot (rpm) | Spin rate in full wet conditions (rpm) |
|---|---|---|---|---|---|---|---|---|---|
| 2012 Cleveland Golf ® RTX wedge (SW) | Conventional milling pattern | 47 | 117 | 849 | 693 | 4828 | 9211 | 1317 | 2579 |
| Exemplary wedge-type club head (SW) | Interference milling pattern | 47 | 103 | 840 | 696 | 4950 | 9134 | 1716 | 3119 |

Furthermore, the above-described club head 100 and method for producing the club head 100 maximize roughness characteristics of the striking face 110 while simultaneously complying with USGA regulations. For example, the average surface roughness Ra and the maximum average peak-to-trough value of the striking face 110 remain below USGA limits. Similarly, dispersion is reduced relative to the art for at least the following reasons. First, multiple deep milling passes are believed to reduce dispersion because subsequent milling passes serve to remove debris and aberrations remaining from prior passes. Second, multiple milling passes at the same cutting depth reduce dispersion versus multiple passes at different cutting depths. Finally, offsetting the feed rate in multiple milling passes allows for these benefits without denigrating the look and feel of the recurrent texture pattern 200.

In an alternate preferred embodiment, illustrated in FIG. 8, a club head 300 may include auxiliary arcuate grooves 310 that may comprise a series of concentric circles that may radiate outwardly. For example, the arcuate grooves 310

452. For example, such circular grooves may be centered at a predetermined optimal impact point that is different from the face center. Such concentric circular auxiliary arcuate grooves may be formed, for example, by stamping, via chemical etching, via laser etching, via sandblasting or other form of media blasting, or other known processes.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A method of manufacturing a golf club head comprising the steps of:

surface milling a striking face of a golf club head body by advancing a first cutter across the striking face in a first pass associated with a first feed rate, resulting in forming a first plurality of auxiliary grooves having a first groove pitch, P1, no less than 0.010 in; and surface milling the striking face of the club head body by advancing a second cutter across the striking face in a second pass associated with a second feed rate that is less than the first feed rate, resulting in forming a second plurality of auxiliary grooves have a second groove pitch P2 that is less than the first pitch and no less than 0.010 in, wherein the first plurality of auxiliary grooves and the second plurality of auxiliary grooves are at least partially coextensive, resulting in an interference pattern.

2. The method of claim 1, wherein the first pass is further associated with a first spin rate and the second pass is further associated with a second spin rate that is substantially equal to the first spin rate.

3. The method of claim 1, wherein the first pass is further associated with a first cutter depth and the second pass is further associated with a second cutter depth that is substantially equal to the first cutter depth.

4. The method of claim 1, wherein at least one of:

the first pitch is between 0.02 in and 0.03 in; and the second pitch is between 0.02 in and 0.03 in.

5. The method of claim 1, wherein a ratio of the first pitch to the second pitch is between 1.05 and 1.20.

6. The method of claim 1, wherein:

in forming the first plurality of auxiliary grooves, the first cutter includes a first plurality of cutter bits; and in forming the second plurality of auxiliary grooves, the second cutter includes a second plurality of cutter bits that are the same as, or identical to, the first plurality of cutter bits.

7. The method of claim 1, wherein the first plurality of auxiliary grooves are generally parallel to the second plurality of auxiliary grooves.

8. The method of claim 1, further comprising applying a surface finish to the striking face, the surface finish being selected from the group consisting of: nickel-plating, chrome plating, laser etching, chemical etching, anodizing, physical vapor deposition, media blasting, and peening.

9. The method of claim 1, further comprising generating a finished club head such that the striking face includes a textured region having a maximum profile height parameter Rt no less than 1000 μin, and an average maximum profile height parameter Rz no greater than 1000 μin.

10. The method of claim 1, wherein the golf club head body is an iron-type golf club head body.

11. The method of claim 1, wherein the golf club head body is a wedge-type golf club head body.

12. A golf club head comprising a striking face including a textured region having a maximum profile height parameter Rt no less than 1020 μin and an average maximum profile height parameter Rz no greater than 900 μin, wherein:

the textured region comprises:

a first plurality of auxiliary grooves each having an average depth no greater than 0.10 mm, the first plurality of auxiliary grooves having a first groove pitch P1 no less than 0.01 in; and a second plurality of auxiliary grooves at least partially coextensive with the first plurality of grooves and each having an average depth no greater than 0.10 mm, the second plurality of auxiliary grooves having a second groove pitch P2 no less than 0.01 in and different from the first groove pitch; and the first plurality of auxiliary grooves and the second plurality of auxiliary grooves form a recurrent texture pattern, the recurrent texture pattern being a plurality of variably-structured depressions that, in combination, form a characteristic and repeating elemental sequence having a period, T, the period T being defined as a length of the elemental sequence of the recurrent texture pattern measured in its direction of propagation, wherein the period T is between 0.20 in and 0.35 in.

13. The golf club head of claim 12, wherein at least one of:

P1 is between 0.02 in and 0.03 in; and

P2 is between 0.02 in and 0.03 in.

14. The golf club head of claim 12, wherein a ratio of P1 to P2 is between 1.05 and 1.20.

15. The golf club head of claim 12, wherein the first plurality of auxiliary grooves are generally parallel to the second plurality of auxiliary grooves.

16. The golf club head of claim 12, wherein the striking face further comprising a surface finish selected from the group consisting of: nickel-plated, chrome plated, laser etched, chemical etched, anodized, physical vapor deposited, media blasted, and peened.

17. The golf club head of claim 12, wherein the golf club head is an iron-type golf club head.

18. The golf club head of claim 12, wherein the golf club head is a wedge-type golf club head.

* * * * *